US005959232A

United States Patent [19]

Wakuda

[11] Patent Number: 5,959,232

[45] Date of Patent: Sep. 28, 1999

[54] ELECTRONIC MUSICAL INSTRUMENT AND A METHOD OF DYNAMIC CHANNEL ASSIGNMENT FOR SOLO AND NON-SOLO TONES

[75] Inventor: Sadamoto Wakuda, Hamamatsu, Japan

[73] Assignee: Kabushiki Kaisha Kawai Gakki Seisakusho, Japan

[21] Appl. No.: 09/130,692

[22] Filed: Aug. 6, 1998

[30] Foreign Application Priority Data

Aug. 22, 1997 [JP] Japan ..... 9-241755

[51] Int. Cl.[6] ..... G10H 1/22

[52] U.S. Cl. ..... 84/618; 84/656; 84/DIG. 2

[58] Field of Search ..... 84/618, 656, DIG. 2, 84/DIG. 27

[56] References Cited

U.S. PATENT DOCUMENTS 4,336,735 6/1982 Amano et al. ..... 84/618 X
4,402,245 9/1983 Oya et al. ..... 84/DIG. 2
5,252,774 10/1993 Hasebe et al. ..... 84/618
5,369,224 11/1994 Miyata ..... 84/DIG. 27
5,668,339 9/1997 Shin ..... 84/DIG. 27
5,804,755 9/1998 Furukawa ..... 84/656

*Primary Examiner*—Stanley J. Witkowski
*Attorney, Agent, or Firm*—Christie, Parker & Hale, LLP

[57] ABSTRACT

An electronic musical instrument having a plurality of tone generation channels includes a solo tone channel assignment means and a non-solo tone channel assignment means. The solo tone channel assignment means preferentially operates to assign a solo tone to be generated to an unoccupied one of the plurality of tone generation channels. The assigned channel number is stored in a solo tone channel information memory. The non-solo tone assignment means looks up the solo tone channel information memory upon checking unoccupied channel information, and assigns tone information to an unoccupied channel excluding the channel number recorded in that memory. A solo tone is dynamically assigned to an unoccupied channel. That assigned channel is reserved without being assigned as a non-solo tone channel, and the solo and non-solo tones do not compete in channel assignment.

10 Claims, 6 Drawing Sheets

ELECTRONIC MUSICAL INSTRUMENT AND A METHOD OF DYNAMIC CHANNEL ASSIGNMENT FOR SOLO AND NON-SOLO TONES

BACKGROUND OF THE INVENTION

1. Field of the Invention

The present invention relates to an assignment method for assigning tone information of a solo tone to a tone generator channel, an electronic musical instrument having an assign function of assigning tone information of a solo tone to a tone generator channel, and a storage medium which computer-readably stores steps of assign processing for assigning tone information of a solo tone to a tone generator channel.

2. Description of the Prior Art

As a conventional method of assigning tone information of a solo tone to a tone generator channel, two different assignment methods, i.e., permanent assignment and dynamic assignment are available, and one of these methods is used in electronic musical instruments and the like.

In the permanent assignment method, a tone generator channel (to be also simply referred to as a channel hereinafter) for a solo tone is prepared in advance, and the tone information of the solo tone is always assigned to that channel prepared in advance.

By contrast, in the dynamic assignment method, no tone generator channel for a solo tone is particularly assigned, and all the tone generator channels are shared by the solo tone and other tones.

However, in the permanent assignment method, when the next key-ON event is detected during generation of a solo tone, the solo tone that is being generated is cut off, and a new solo tone is generated. At this time, an identical tone generator channel (that for a solo tone) is used. That is, since cutoff of the currently generated solo tone and generation of a new solo tone must be switched in an identical tone generator channel within a short period of time, noise is often produced.

In order to avoid such noise from being produced, another permanent assignment method is known. In this method, not one but two or three tone generator channels including an auxiliary tone generator channel are prepared in advance as those for a solo tone, and one of these tone generator channels is adaptively selected and used.

However, when such a method is used, a plurality of tone generator channels is often occupied by one solo tone to be generated in the instrument.

On the other hand, in the above-mentioned conventional dynamic assignment method, when all the tone generator channels are occupied, and a tone corresponding to the latest ON event is preferentially assigned, a solo tone and other tones may conflict to result in cutting off each others' tones.

The aforementioned problem is especially conspicuous when a solo tone is continuously generated. Conventionally, a solo tone cannot be satisfactorily obtained due to noise produced when a solo tone next to the currently generated solo tone is to be generated.

SUMMARY OF THE INVENTION

It is, therefore, an object of the present invention to remove the above-mentioned shortcomings, and to provide an assignment method that can always satisfactorily generate a solo tone, an electronic musical instrument which can always satisfactorily generate a solo tone, and a storage medium which computer-readably stores processing steps for always satisfactorily generating a solo tone.

According to the present invention, an assignment method for assigning tone information of solo and non-solo tones to be assigned to a plurality of tone generator channels, comprises: a solo tone assignment step of assigning tone information of a solo tone to an unoccupied channel of the plurality of tone generator channels; a storage step of storing information of the tone generator channel to which the tone information is assigned in the solo tone assignment step; and a non-solo tone assignment step of assigning tone information of a non-solo tone to an unoccupied channel of the plurality of tone generator channels, and the non-solo tone assignment step includes the step of assigning the tone information to an unoccupied channel other than the tone generator channel for the solo tone indicated by the information stored in the storage step.

The solo tone assignment step includes a step of assigning the tone information to an unoccupied channel determined by a predetermined priority order.

According to the present invention, an electronic musical instrument for assigning tone information of solo and non-solo tones to be assigned to a plurality of tone generator channels, comprises: solo tone assignment means for assigning tone information of a solo tone to an unoccupied channel of the plurality of tone generator channels; storage means for storing information of the tone generator channel to which the tone information is assigned by the solo tone assignment means; and non-solo tone assignment means for assigning tone information of a non-solo tone to an unoccupied channel of the plurality of tone generator channels, and the non-solo tone assignment means assigns the tone information to an unoccupied channel other than the tone generator channel for the solo tone indicated by the information stored in the storage means.

The solo tone assignment means assigns the tone information to an unoccupied channel determined by a predetermined priority order.

A storage medium according to the present invention computer-readably stores the processing steps of the assignment method of claim 1 or 2.

DESCRIPTION OF THE PREFERRED EMBODIMENTS

An embodiment of the present invention will now be described with reference to the accompanying drawings.

Figure 1:
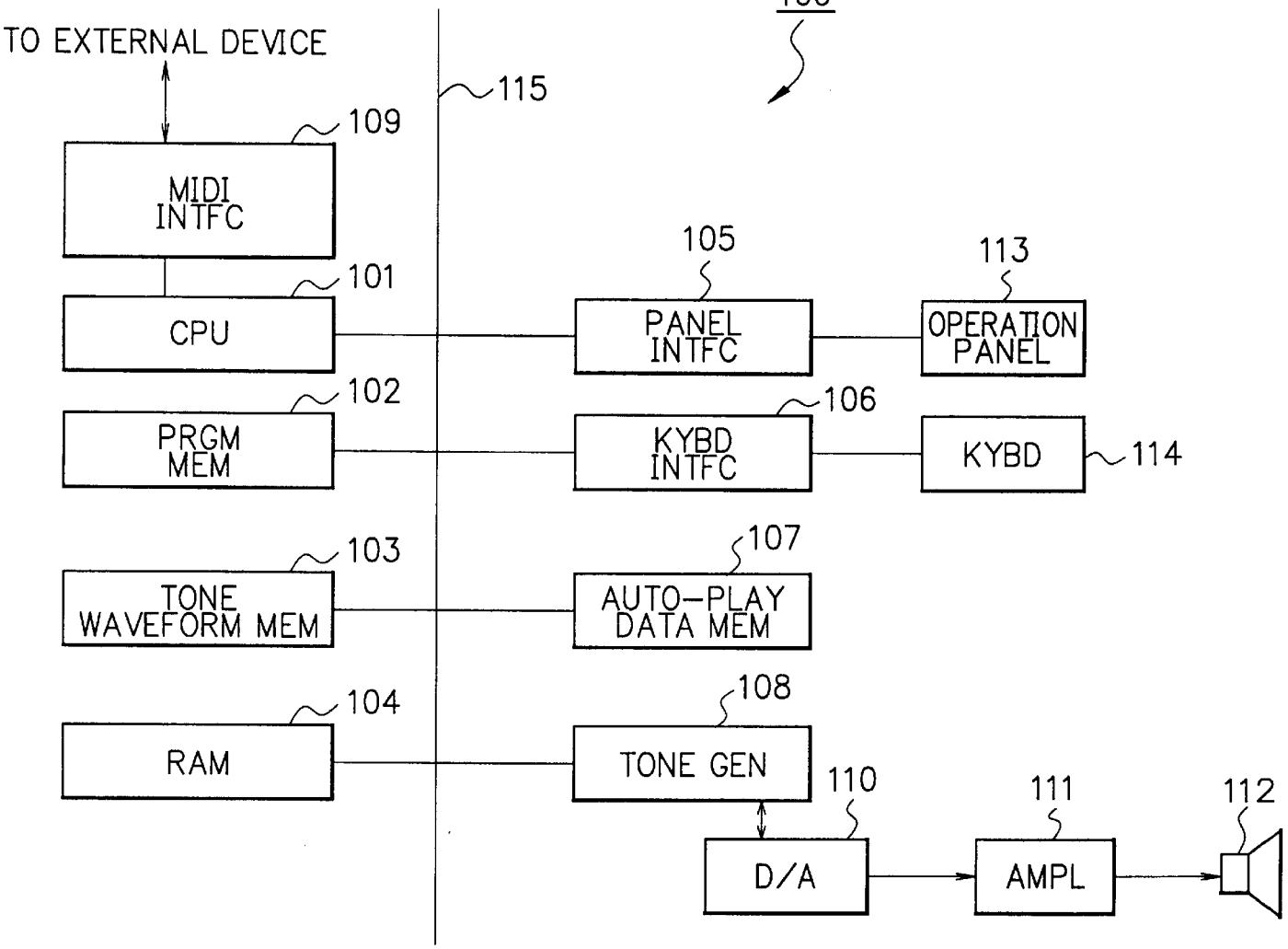
FIG. 1 is a block diagram showing the arrangement of an electronic musical instrument to which an assignment method of the present invention is applied.

An assignment method according to the present invention is used in, e.g., an electronic musical instrument 100, as shown in FIG. 1. The electronic musical instrument 100 is an application of an electronic musical instrument according to the present invention.

More specifically, the electronic musical instrument 100 has an assignment function of assigning tone information of a solo tone to a tone generation channel. As shown in FIG. 1, a CPU (Central Processing Unit) 101 to which a MIDI (Musical Instrument Digital Interface) interface circuit 109 is connected, a program memory 102 comprised of, e.g., a ROM (Read Only Memory), a tone waveform memory 103, a RAM (Random Access Memory) 104, a panel interface circuit 105 to which an operation panel 113 is connected, a keyboard interface circuit 106 to which a keyboard device 114 is connected, an auto-play data memory 107, and a tone generator 108 to which a digital/analog (D/A) converter 110 is connected, are connected to a bus 115, and can exchange data with each other.

An amplifier 111 is connected to the D/A converter 110, and a loudspeaker 112 is connected to the amplifier 111, so that the output from the tone generator 108 is output from the loudspeaker 112 via the D/A converter 110 and amplifier 111 in turn.

The keyboard device 114 is comprised of one or a plurality of keyboards each including a plurality of keys and key switches corresponding to these keys. Each key switch detects key-ON and key-OFF events, and also detects the operation speed of a key, and the like.

The state of each key in the keyboard device 114 is detected by the CPU 101 via the keyboard interface circuit 106.

On the operation panel 113, a plurality of operation members to which functions such as rhythm, tone color, tone volume, effect, and like functions are respectively assigned, a demonstration switch used for instructing an auto-play based on auto-play data pre-set in the auto-play data memory 107, etc. are disposed.

The operation state on operation panel 113 is also detected by the CPU 101 via the panel interface circuit 105.

The tone waveform memory 103 stores tone waveform data, and the auto-play data memory 107 stores auto-play data.

The RAM 104 has storage areas for temporarily storing various kinds of information in the steps of executing various kinds of processing, and for storing information obtained as a result of various kinds of processing.

The program memory 102 pre-stores various processing programs and data used for controlling the overall electronic musical instrument 100. The CPU 101 reads out a processing program stored in the program memory, and executes the readout program for controlling the overall electronic musical instrument 100.

The MIDI interface circuit 109 exchanges data by MIDI standards as the connection standards between the electronic musical instrument 100 and an external apparatus (not shown). In this way, auto-play data stored in the auto-play data memory 107 can be output to the external apparatus via MIDI channels, so that the external apparatus can automatically play that data. Also, the electronic musical instrument 100 can play based on play information supplied from the external apparatus via the MIDI channels. Furthermore, key information at the keyboard device 114, tone color information set at the operation panel 113, and information like those can be transmitted.

The tone generator 108 comprises a plurality of tone generator channels ch.0 to ch.n. The tone generator 108 can generate a solo tone, and can also generate other tones simultaneously. A tone generator channel for a solo tone, and tone generator channels for non-solo tones are assigned under the control of the CPU 101, as will be described in detail later.

The tone generator 108 forms digital tone data from tone waveform data stored in the tone waveform memory 103 in accordance with play information and the like sent from the CPU 101 via the bus 115.

The tone data formed by the tone generator 108 is converted into an analog signal by the D/A converter 110, and the analog signal is amplified by the amplifier 111. The amplified signal is output as actual sounds from the loudspeaker 112.

Figure 2:
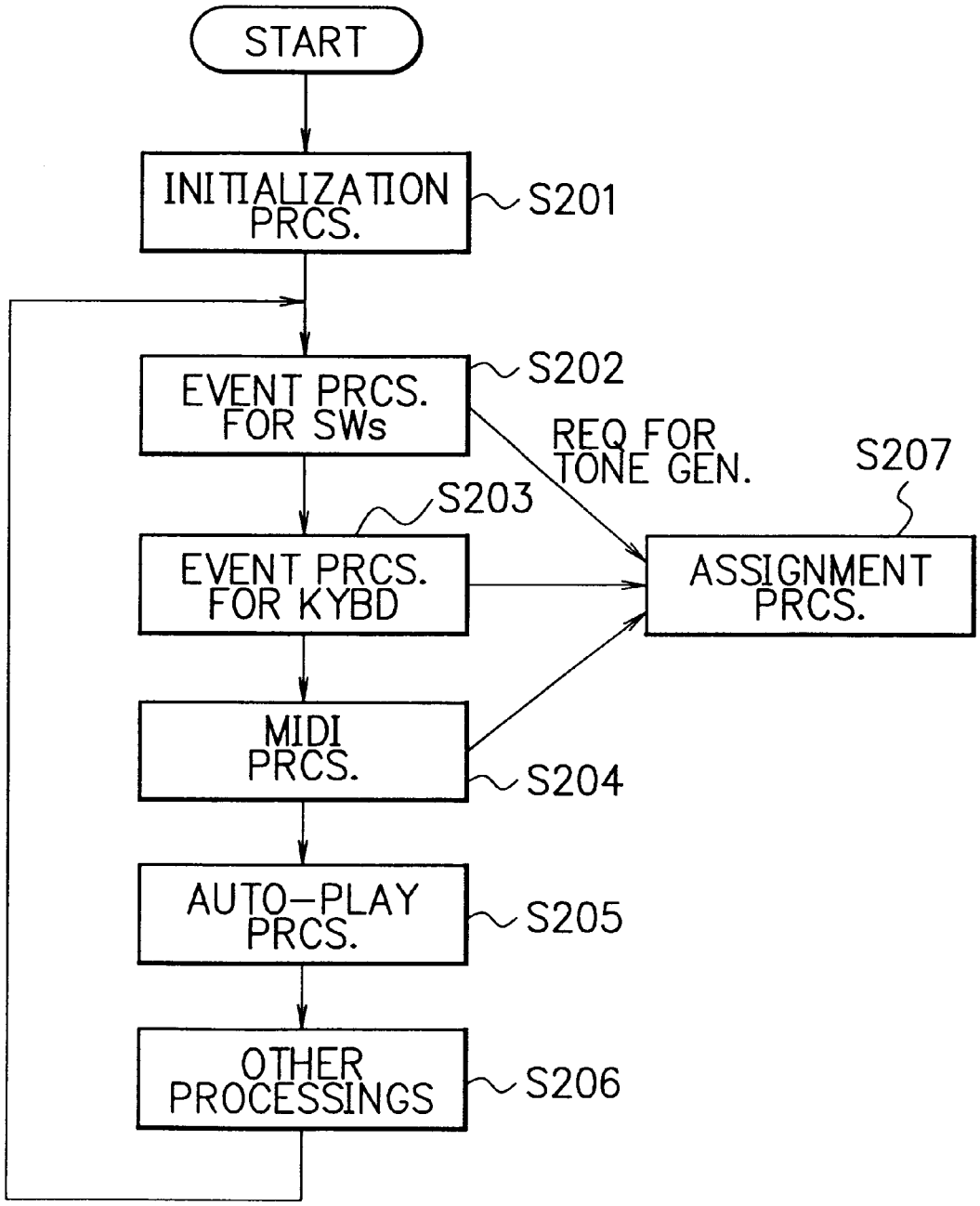
FIG. 2 is a flow chart for explaining the main routine of the electronic musical instrument.

The operation of the above-mentioned electronic musical instrument 100 is controlled by a main processing (main routine) program according to the flow chart shown in, e.g., FIG. 2.

More specifically, the program memory 102 pre-stores the main routine program shown in FIG. 2, and when the power supply of the electronic musical instrument 100 is turned on, the CPU 101 reads out and executes this main routine program.

Hence, when the power supply of the electronic musical instrument 100 is turned on, the CPU 101 executes initialization processing (step S201) to initialize the tone generator, clears the RAM 104, and so forth. After that, the CPU 101 executes switch event processing (step S202) for checking the operation states of the operation members provided to the operation panel 113, keyboard event processing (step S203) for checking the state of the keys provided to the keyboard device 114, MIDI processing (step S204) for receiving play information and the like from the external apparatus, auto-play processing (step S205), and various kinds of other processing (step S206) in turn, and the control then returns to the switch event processing (step S202).

At this time, when auto-play data is set on the operation panel 113 or when a certain key is operated (key ON or key OFF), a tone generation request is issued, or when play information is received from the external apparatus (not shown), the auto-play processing (step S205) issues a tone generation request accordingly. In response to this request, assignment processing (step S207) is executed.

With this processing, tone information of the tone to be generated is assigned to one of tone channels ch.0 to ch.n of the tone generator 108, and the tone generation processing of that tone is executed.

Figure 3:
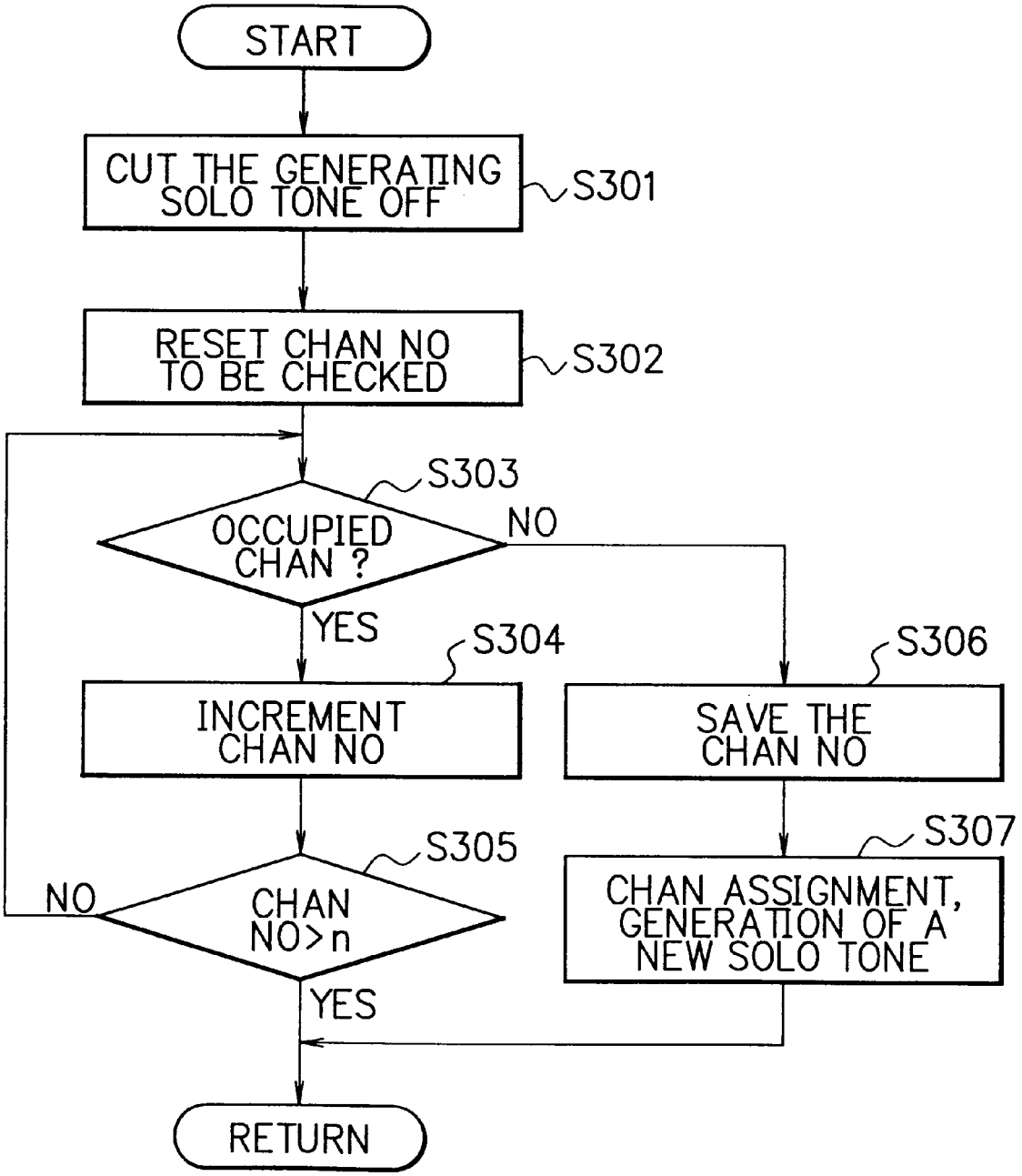
FIG. 3 is a flow chart for explaining solo tone assignment processing included in the assignment processing in the main routine.
Figure 4:
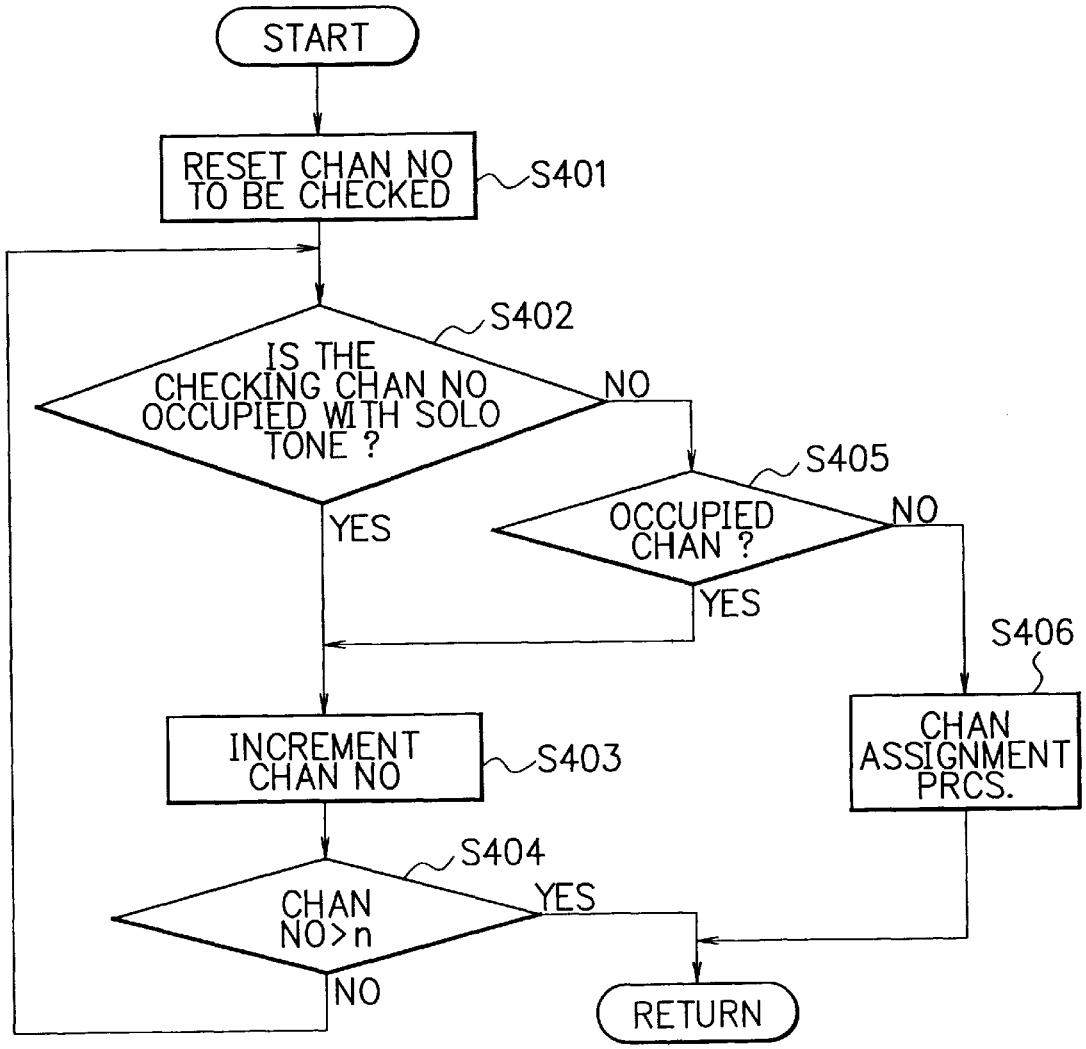
FIG. 4 is a flow chart for explaining non-solo tone assignment processing included in the assignment processing in the main routine.

Such assignment processing includes solo tone assignment processing according to the flow chart shown in, e.g., FIG. 3, and non-solo tone assignment processing according to the flow chart shown in, e.g., FIG. 4, and their processing programs are also pre-stored in the program memory 102.

Note that a storage medium according to the present invention is applied to the program memory 102 that stores the processing programs shown in FIGS. 3 and 4.

Note that, for example, the RAM 104 has a channel occupation information area 511 that stores occupation information of tone generator channels ch.0 to ch.n of the tone generator 108. One-byte buffers corresponding to tone generator channels ch.0 to ch.n are allocated on the channel occupation information area 511. In each buffer, one bit $b_1$ of one byte indicates if tone generation is in progress (key ON event is in progress), and another bit $b_2$ indicates if that channel is being occupied due to the damper pedal operated ON.

The RAM 104 also has an old key information area which stores information of the assignment order (key-ON order: occupation order of channels) of tone information to tone generator channels ch.0 to ch.n.

In these areas, the CPU 101 sets the corresponding information every time each tone (a solo tone or non-solo tone) of a play is generated in accordance with key information generated upon key operation at the keyboard device 114 or play information supplied via the MIDI channels (these pieces of information will be simply referred to as play information hereinafter).

In this electronic musical instrument 100, upon executing the assignment processing for assigning tone information of a solo or non-solo tone to be generated in accordance with the play information to tone generator channels ch.0 to ch.n of the tone generator 108, a tone generator channel for a solo tone is shifted among tone generator channels ch.0 to ch.n unlike the conventional permanent assignment method or dynamic assignment method.

Figure 5:
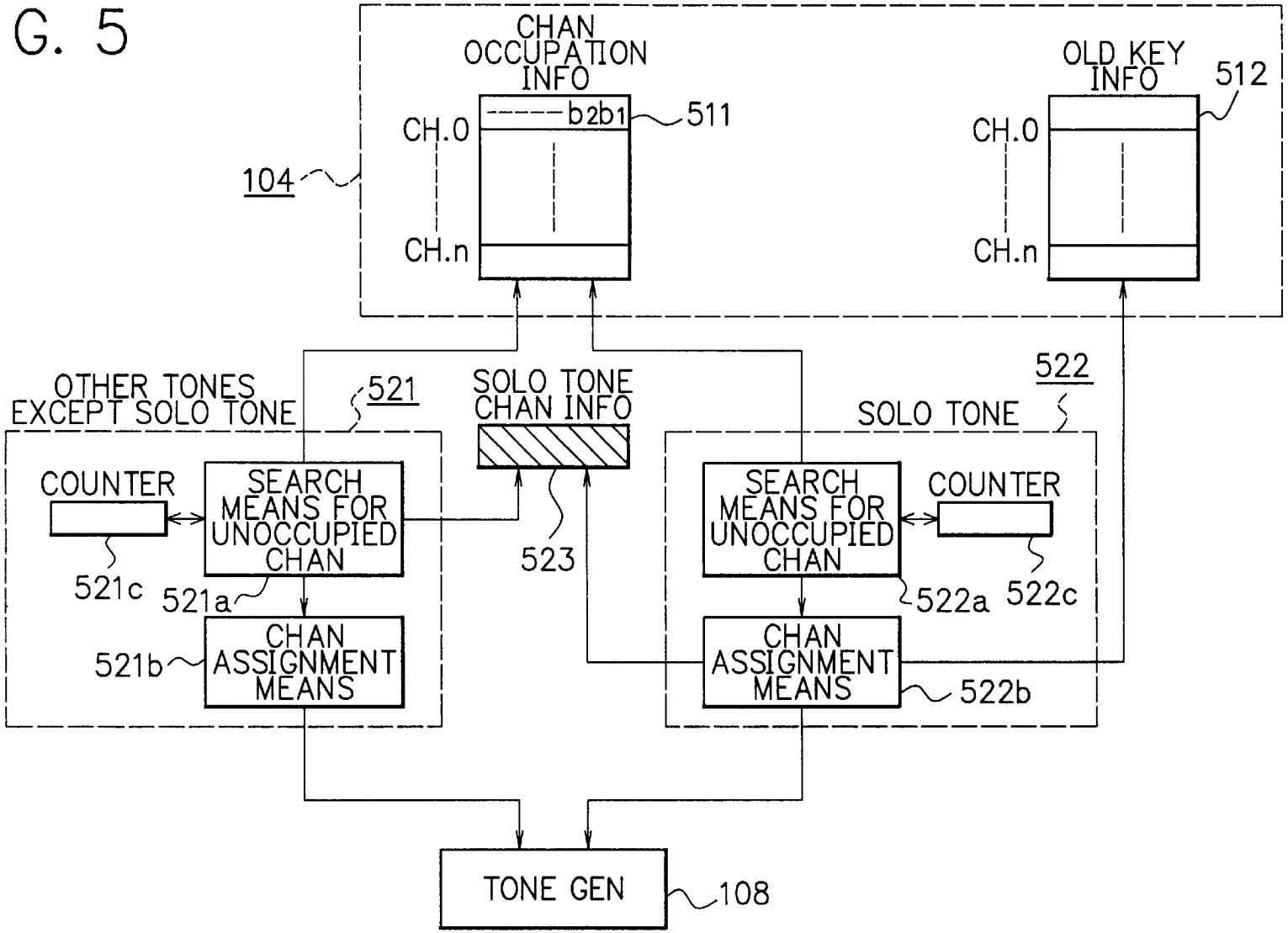
FIG. 5 is a block diagram functionally showing the internal arrangement of a CPU that implements the assignment processing.

For this purpose, the CPU 101 has the arrangement shown in, e.g., FIG. 5.

More specifically, the CPU 101 comprises a solo tone channel assignment means 522, a non-solo tone assignment means 521, and a solo tone channel information storage memory 523 for storing the information (channel number) of a tone generator channel assigned to the solo tone, as shown in FIG. 5.

The solo tone channel assignment means 522 has an unoccupied channel search means 522*a* for accessing the above-mentioned channel occupation information area 511, a channel assignment means 522*b* for accessing the above-mentioned old key information area 512, and a counter 522*c* used by the unoccupied channel search means 522*a*.

The unoccupied channel search means 522*a* outputs the found unoccupied channel to the channel assignment means 522*b*.

The channel assignment means 522*b* assigns tone generator information of the solo tone to be generated to one of tone generator channels ch.0 to ch.n of the tone generator 108, and stores that channel number in the solo tone channel information storage memory 523 at the same time.

On the other hand, the non-solo tone channel assignment means 521 has an unoccupied channel search means 521*a* for looking up the solo tone channel information storage memory 523, a channel assignment means 521*b* that receives the output from the unoccupied channel search means 521*a*, and a counter 521*c* used by the unoccupied channel search means 521*a*.

The unoccupied channel search means 521*a* also accesses the above-mentioned channel occupation information area 511.

The channel assignment means 521*b* assigns tone information of the non-solo tone to be generated to one of tone generator channels ch.0 to ch.n of the tone generator 108.

The access processing executed by the CPU 101 with such arrangement will be explained in detail below with reference to FIGS. 3 to 5.

When tone information of the solo tone to be generated is assigned to one of tone generator channels ch.0 to ch.n of the tone generator 108 (FIG. 3), if generation of the solo tone is currently in progress, the CPU 101 controls the tone generator 108 to cut off that solo tone (step S301).

The tone generator 108 executes processing for cutting off the currently generated solo tone.

At this time, the CPU 101 sets the channel occupation information area 511 so that the occupation information of the tone generator channel which has been used for the cutoff solo tone indicates "unoccupied".

The unoccupied channel search means 522*a* of the CPU 101 clears the counter 522*c* to reset the number of the tone generator channel to be checked (step S302).

After that, the unoccupied channel search means 522*a* begins to search for an unoccupied channel from tone generator channel ch.0.

More specifically, the unoccupied channel search means 522*a* accesses each bit $b_1$ in the channel occupation information area 511 to check if the tone generator channel of interest is occupied (step S303).

In step S302, even when bit $b_1$ in the area 511 that indicates the tone generator channel occupation information does not indicate "occupied" in response to a key-OFF event, tone generation may be in progress due to use of the damper pedal. In this case, the means 522*a* checks bit $b_2$ in the area 511 to determine that the channel is "occupied", and excludes that channel from unoccupied channel candidates.

In this way, information (bit $b_2$) of a channel which is not "occupied" but is generating a tone in practice is also set in the channel occupation information area 511.

If it is determined in step S303 that the tone generator channel of interest is occupied, the unoccupied channel search means 522*a* counts up the counter 522*c* to increment the tone generator channel number to be checked (step S304).

The CPU 101 then checks if the count value of the counter 522*c* has exceeded the last channel number (=n) (step S305).

If it is determined in step S305 that the count value of the counter 522*c* has exceeded the last channel number (=n), the CPU 101 ends this processing; otherwise, the CPU 101 returns to the checking processing in step S303 above to execute processing for the next tone generator channel.

If it is determined in step S303 that the tone generator channel of interest is not occupied, the channel assignment means 522*b* of the CPU 101 stores the number of that unoccupied channel in the solo tone channel information storage memory 523 as that of a tone generator channel for a solo tone (step S306).

The channel assignment means 522*b* assigns tone information of a new solo tone to be generated to that unoccupied channel. The CPU 101 controls the tone generator 108 to generate that new solo tone using the tone generator channel for the solo tone, thus ending this processing (step S307).

At this time, the CPU 101 sets the channel occupation information area 511 so that the occupation information of the tone generator channel for the solo tone assigned by the channel assignment means 522*b* indicates "occupied".

In this way, the tone generator 108 executes processing for generating the new solo tone.

On the other hand, when a non-solo tone to be generated is assigned to one of tone generator channels ch.0 to ch.n of the tone generator 108, the unoccupied channel search means 521*a* of the CPU 101 clears the counter 521*c* to reset the number of the tone generator channel to be checked (step S401), as shown in FIG. 4.

After that, the unoccupied channel search means 521*a* begins to search for an unoccupied channel from tone generator channel ch.0.

More specifically, the unoccupied channel search means 521*a* looks up the solo tone channel information storage memory 523 to check if the tone generator channel of interest is a tone generator channel for a solo tone (step S402).

If it is determined in step S402 that the tone generator channel of interest is a tone generator channel for a solo tone, the unoccupied channel search means 521*a* counts up the counter 521*c* to increment the number of the tone generator channel to be checked (step S403).

The CPU 101 then checks if the count value of the counter 521*c* has exceeded the last channel number (=n) (step S404).

If it is determined in step S404 that the count value of the counter 521*c* has exceeded the last channel number (=n), the CPU 101 ends this processing; otherwise, the CPU 101 returns to the checking processing in step S402 to execute processing for the next tone generator channel.

If it is determined in step S402 that the tone generator channel of interest is not a tone generator channel for a solo tone, the unoccupied channel search means 521*a* accesses the channel occupation information area 511 to check if that tone generator channel of interest is "unoccupied" or "occupied" (step S405).

In step S405 as well, if the occupation information of the tone generator channel does not indicate "occupied" but that channel is generating a tone in practice due to the use of the damper pedal or the like, the means 521*a* determines that the channel is "occupied", and excludes that channel from unoccupied channel candidates, as in step S302 above.

If it is determined in step S405 that the tone generator channel of interest is "occupied", the unoccupied channel search means 521*a* counts up the counter 521*c* to increment the number of the tone generator channel to be checked (step S403).

After that the above-mentioned checking processing in step S404 is done, and this processing ends or the processing for the next tone generator channel is executed.

If it is determined in step S405 that the tone generator channel of interest is "unoccupied", the unoccupied channel search means 521*a* supplies this result to the channel assignment means 521*b* of the CPU 101.

The channel assignment means 521*b* assigns tone information of a new non-solo tone to be generated to the tone generator channel indicated by the search result from the unoccupied channel search means 521*a* (step S406).

At this time, the CPU 101 sets the channel occupation information area 511 so that the occupation information of the tone generator channel for a non-solo tone assigned by the channel assignment means 521*b* indicates "occupied".

The CPU 101 controls the tone generator 108 to generate a new non-solo tone using the tone generator channel for a non-solo tone, thus ending this processing.

Then, the tone generator 108 executes processing for generating a new non-solo tone.

As described above, in this embodiment, upon generating a solo tone, the currently generated solo tone is cut off, and tone information of a new solo tone is assigned to an unoccupied channel of the tone generator 108. In this case, the number of the assigned tone generator channel is stored in the solo tone channel information storage area 523. When a non-solo tone is generated, tone information of that tone is assigned to a tone generator channel other than that stored in the solo tone channel information storage area 523.

With this control, the tone generator channel to which tone information of a solo tone is assigned is excluded from channel candidates to which tone information of a non-solo tone is assigned independently of its occupation information (i.e., "occupied" or "unoccupied"). Respective numbers of tone generator channels used for a solo tone and non-solo tones remains unchanged. More specifically, a tone generator channel for a solo tone is always assured, and shifts among tone generator channels ch.0 to ch.n of the tone generator 108. Also, the solo and non-solo tones can be prevented from conflicting to result in cutting off each others' tones.

Hence, noise production due to use of an identical tone generator channel, unwanted cutoff of tones, and the like can be reliably prevented unlike in the prior art. Even when the next solo tone is to be generated while a given solo tone is being generated, it can be satisfactorily generated without producing noise.

Figure 6:
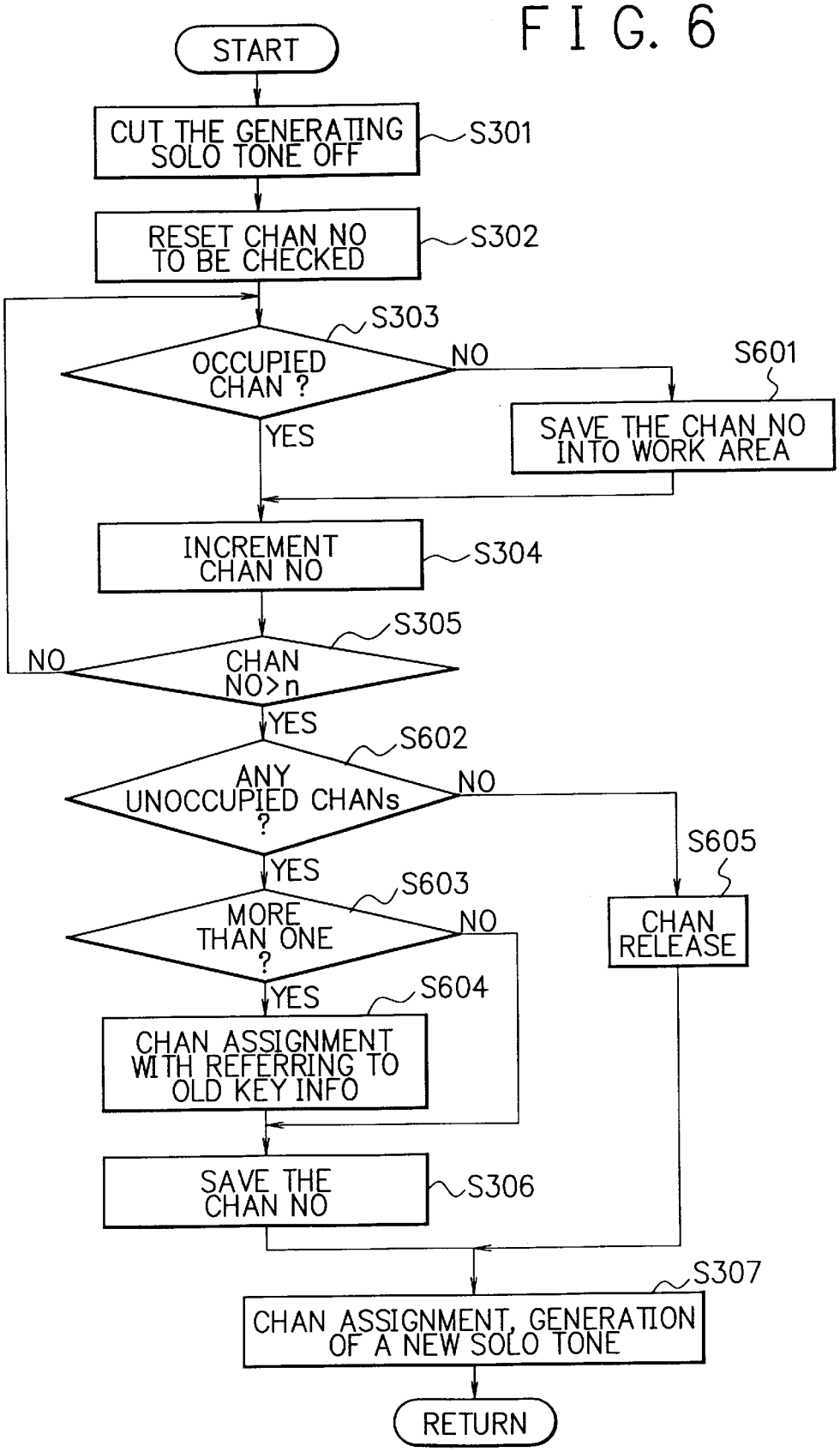
FIG. 6 is a flow chart showing solo tone assignment processing when there are a plurality of unoccupied channels.

FIG. 6 shows a modification of the processing flow corresponding to FIG. 3, i.e., assignment of a solo tone when there are a plurality of unoccupied channels upon channel assignment. The same step numbers in FIG. 6 denote steps corresponding to those in FIG. 3, and a detailed description thereof will be omitted.

In FIG. 6, if an unoccupied channel is detected in step S303, the number of that channel is saved in a work area in step S601. After that, unoccupied channel detection repeats itself while incrementing the channel number in step S304 until it is determined in step S305 that the channel number has exceeded the last channel number n.

After checking is done up to the last channel number, the presence/absence of an unoccupied channel is checked in step S602 by looking up the work area. If the presence of an unoccupied channel is detected, it is checked in step S603 if one or a plurality of unoccupied channels are detected. If a plurality of unoccupied channels are detected, the channel assignment means 522*b* looks up the old key information area to detect the oldest occupied channel of a plurality of unoccupied channels in step S604, and assigns tone information of a solo tone to that channel. If it is determined in step S603 that only one unoccupied channel is detected, tone information of a solo tone is assigned to that channel.

Therefore, upon assigning tone information of a solo tone to an unoccupied channel of tone generator channels ch.0 to ch.n, if there are a plurality of unoccupied channels, the priority order is determined based on the occupation order (key-ON order) of the channels, and tone information of a solo tone is assigned to an unoccupied channel with the oldest occupation order. Hence, tone information can be assigned to a tone generator channel in which a tone has already been cut off, thus further reliably preventing noise production.

In the aforementioned embodiment, if there are a plurality of unoccupied channels, the priority order is determined based on the occupation order (key-ON order) of the channels. However, the present invention is not limited to such a specific method. For example, the priority order may be determined based on the release order (key-OFF order) of channels or in ascending the levels of tones assigned to channels upon next assignment (attenuation order).

If it is determined in step S602 in FIG. 6 that there is no unoccupied channel, one channel is released in step S605, and a solo tone is assigned to that channel.

More specifically, if all the channels are occupied for generating tones corresponding to key-ON events or for sustaining the generated tones because of use of the damper pedal, one with higher priority order (e.g., the oldest key-OFF timing) of a plurality of tone generation sustaining channels by the damper is released (tone is cut off), and that channel is used. On the other hand, when all the channels are occupied by key-ON tones, the priority order is determined by the key-ON order or attenuation order.

The objectives of the present invention are also achieved not only by the electronic musical instrument 100 in the above embodiment, but also by supplying a storage medium which stores a program code of software that implements the functions of the CPU 101 to a system or apparatus, and executing the program code read out from the storage medium by a computer (or CPU or MPU) of the system or apparatus.

As a storage medium for supplying the program code, for example, a floppy disk, hard disk, optical disk, magnetooptical disk, CD-ROM, CD-R, magnetic tape, nonvolatile memory card, ROM (like the above-mentioned program memory 102), and the like may be used.

To recapitulate, according to the present invention, upon generating a solo tone, tone information of the solo tone to be generated is assigned to an unoccupied one of a plurality of tone generator channels, and the information (channel number) of the channel assigned at that time is stored. Upon generating a non-solo tone, tone information of the non-solo tone to be generated is assigned to an unoccupied channel other than the stored channel (tone generator channel for the solo tone).

With this control, the tone generator channel to which tone information of a solo tone is assigned is excluded from channel candidates to which tone information of a non-solo tone is assigned independently of its occupation information (i.e., "occupied" or "unoccupied"). Respective numbers of tone generator channels used for a solo tone and non-solo tones remains unchanged. More specifically, a tone generator channel for a solo tone is always assured, and shifts among a plurality of tone generator channels. Also, the solo and non-solo tones can be prevented from conflicting to result in cutting off each others' tones.

Hence, noise production due to use of an identical tone generator channel, unwanted cutoff of tones, and the like can be reliably prevented unlike in the prior art. Even when solo tones are to be generated successively, they can be satisfactorily generated without producing noise.

Upon assigning tone information of a solo tone to an unoccupied one of tone generator channels, the priority order is determined based on the key-ON order (occupation order of channels), key-OFF order (release order of channels), attenuation order (ascending order of the levels of tones assigned to channels upon next assignment), or the like, and that tone information is assigned to an unoccupied channel with higher priority order. Hence, when there are a plurality of unoccupied channels, tone information is assigned from a channel with higher priority order (from the oldest occupied channel, the oldest released channel, the smallest level of a tone, or the like). With this control, noise can be more reliably prevented from being generated.

What is claimed is:

1. An assignment method for assigning tone information of solo and non-solo tones dynamically to a plurality of tone generator channels which have no specific, exclusive channels for the solo tone, comprising:

a releasing step of releasing a solo tone generator channel currently assigned in one of the plurality of tone generator channels to cutoff the currently generating solo tone;

a solo tone assignment step of assigning tone information of a solo tone to be newly generated to an unoccupied channel of the plurality of tone generator channels;

a storage step of storing channel identifying information of the tone generator channel to which the solo tone information is assigned in the solo tone assignment step; and a non-solo tone assignment step of assigning tone information of a non-solo tone to an unoccupied channel of the plurality of tone generator channels, wherein the non-solo tone assignment step includes the step of assigning the non-solo tone information to an unoccupied channel other than the tone generator channel for the solo tone indicated by the channel identifying information stored in the storage step.

2. A method according to claim 1, wherein the solo tone assignment step includes a step of assigning the tone information to an unoccupied channel determined by a predetermined priority order when there are a plurality of unoccupied channels.

3. A method according to claim 1, wherein said solo tone assignment step includes:

an unoccupied channel search step of searching each tone generator channel for unoccupied tone generator channels, and a dynamic assigning step of assigning said solo tone information to an unoccupied channel found by said unoccupied channel search step.

4. A method according to claim 1, further comprising a recording step of recording old key information indicating channel numbers in order of occurrence of the tone generator channel assignments, and further wherein said solo tone assignment step and said non-solo tone assignment step include a step of releasing the oldest assigned channel with reference to said old key information if there is no unoccupied channel.

5. An electronic musical instrument assigning tone information of solo and non-solo tones dynamically to a plurality of tone generator channels which have no specific, exclusive channels for the solo tone, comprising:

releasing means for releasing a solo tone generator channel currently assigned in one of the plurality of tone generator channels to cutoff the currently generating solo tone;

solo tone assignment means of assigning tone information of a solo tone to be newly generated to an unoccupied channel of the plurality of tone generator channels;

storage means for storing channel identifying information of the tone generator channel to which the solo tone information is assigned in the solo tone assignment means; and non-solo tone assignment means for assigning tone information of a non-solo tone to an unoccupied channel of the plurality of tone generator channels, wherein the non-solo tone assignment means includes the means of assigning the non-solo tone information to an unoccupied channel other than the tone generator channel for the solo tone indicated by the channel identifying information stored in the storage means.

6. An instrument according to claim 5 wherein said solo tone assignment means comprises means for checking unoccupied ones of all the channels, and assigns the tone information to an unoccupied channel determined by a predetermined priority order when there are a plurality of unoccupied channels.

7. An instrument according to claim 5, wherein said solo tone assignment means includes:

an unoccupied channel search means for searching each tone generator channel for unoccupied tone generator channels, and a dynamic assigning means for assigning said solo tone information to an unoccupied channel found by said unoccupied channel search means.

8. An instrument according to claim 5, further comprising a recording means for recording old key information indicating channel numbers in order of occurrence of the tone generator channel assignments, and further wherein said solo tone assignment means and said non-solo tone assignment means include means for releasing the oldest assigned channel with reference to said old key information if there is no unoccupied channel.

9. A storage medium to be incorporated in an electronic musical instrument, said storage medium computer-readably storing the processing steps of assigning tone information of solo and non-solo tones dynamically to a plurality of tone generator channels which have no specific, exclusive channels for the solo tone, comprising:

a releasing step of releasing a solo tone generator channel currently assigned in one of the plurality of tone generator channels to cutoff the currently generating solo tone;

a solo tone assignment step of assigning tone information of a solo tone to be newly generated to an unoccupied channel of the plurality of tone generator channels, a storage step of storing channel identifying information of the tone generator channel to which the solo tone information is assigned in said solo tone assignment step; and a non-solo tone assignment step of assigning tone information of a non-solo tone to an unoccupied channel of the plurality of tone generator channels, wherein the non-solo tone assignment step includes the step of assigning the non-solo tone information to an unoccupied channel other than the tone generator channel for the solo tone indicated by the channel identifying information stored in the storage step.

10. A storage medium according to claim 9 wherein said solo tone assignment step includes:

an unoccupied channel search step of searching each tone generator channel for unoccupied tone generator channels, and a dynamic assigning step of assigning said solo tone information to an unoccupied channel found by said unoccupied channel search step.

* * * * *